US006486850B2

(12) United States Patent
Apostolos

(10) Patent No.: US 6,486,850 B2
(45) Date of Patent: Nov. 26, 2002

(54) SINGLE FEED, MULTI-ELEMENT ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 09/844,135

(22) Filed: Apr. 27, 2001

(65) Prior Publication Data

US 2001/0035842 A1 Nov. 1, 2001

Related U.S. Application Data

(60) Provisional application No. 60/199,874, filed on Apr. 27, 2000, and provisional application No. 60/203,751, filed on May 12, 2000.

(51) Int. Cl.[7] ..... H01Q 1/48

(52) U.S. Cl. ..... 343/848; 343/895

(58) Field of Search ..... 343/848, 806, 343/813, 862, 770, 700 MS, 895, 745, 823, 905; H01Q 1/48

(56) References Cited

U.S. PATENT DOCUMENTS

| | | | | |
|---|---|---|---|---|
| 3,633,207 A | | 1/1972 | Ingerson et al. | 343/770 |
| 3,736,534 A | | 5/1973 | Chaffee | 333/31 R |
| 3,754,197 A | | 8/1973 | Cristal | 333/33 |
| 3,754,271 A | | 8/1973 | Epis | 343/756 |
| 3,849,745 A | | 11/1974 | Schellenberg et al. | 333/31 R |
| 4,010,474 A | | 3/1977 | Provencher | 343/814 |
| 4,286,271 A | * | 8/1981 | Barbano et al. | 343/792.5 |
| 4,293,858 A | | 10/1981 | Hockham | 343/731 |
| 4,410,893 A | | 10/1983 | Griffee | 343/792 |
| 4,786,914 A | | 11/1988 | Wu et al. | 343/909 |
| 4,970,524 A | * | 11/1990 | Hens | 343/752 |
| 5,144,319 A | | 9/1992 | Roberts | 343/372 |
| 5,504,466 A | * | 4/1996 | Chan-Son-Lnit et al. | 333/15 |
| 5,790,080 A | | 8/1998 | Apostolos | 343/744 |
| 5,892,490 A | | 4/1999 | Asakura et al. | 343/895 |
| 5,943,011 A | | 8/1999 | Acoraci et al. | 342/373 |
| 5,949,303 A | | 9/1999 | Arvidsson et al. | 333/136 |
| 6,075,424 A | | 6/2000 | Hampel et al. | 333/161 |
| 6,121,931 A | | 9/2000 | Levi | 343/700 MS |
| 6,218,992 B1 | * | 4/2001 | Sadlet et al. | 343/702 |
| 6,246,368 B1 | * | 6/2001 | Deming et al. | 343/700 MS |

FOREIGN PATENT DOCUMENTS

| | | |
|---|---|---|
| WO | WO 98/49742 | 11/1998 |
| WO | WO 00/52784 | 9/2000 |
| WO | WO 01/13464 | 2/2001 |

OTHER PUBLICATIONS

PCT International Search Report dated Jul. 26, 2001 of International Application No. PCT/US01/13653 filed Apr. 27, 2001.

* cited by examiner

*Primary Examiner*—Don Wong
*Assistant Examiner*—Trinh Vo Dinh
(74) *Attorney, Agent, or Firm*—Scott J. Asmus; Vernon C. Maine; Maine & Asmus

(57) ABSTRACT

An array antenna capable of use with a single signal feed has a transmission line oriented substantially parallel to a ground plane, which transmission line has a multiplicity of sequential sections with each sequential section having a different spacing from the ground plane than each of its immediately adjacent sequential sections. This stepped or varied impedance transmission line forms an array in which the sections spaced further from the ground plane become active antenna elements. Controlling an electrical spacing between the ground plane and transmission line provides relative phase control between the active elements and thereby phased-array directional control of the antenna.

19 Claims, 10 Drawing Sheets

SINGLE FEED, MULTI-ELEMENT ANTENNA

RELATED APPLICATION

The present application claims priority from U.S. Provisional Patent Applications Ser. No. 60/199,874, filed Apr. 27, 2000 and Ser. No. 60/203,751, filed May 12, 2000.

FIELD OF INVENTION

The present invention relates to antennas and, more specifically to multi-element antennas or array antennas.

BACKGROUND OF THE INVENTION

In the past, efficient antennas have typically required structures with minimum dimensions on the order of a quarter wavelength of the radiating frequency. These dimensions allowed the antenna to be excited easily and to be operated at, or near a resonance frequency. This limited the energy dissipated in resistive losses and maximized the transmitted energy. Even at relatively high frequencies, these antennas tended to be large at the resonant wavelength. Further, as frequency decreased, the antenna dimensions had to increase in proportion.

In order to address the shortcomings of traditional antenna design and functionality, a new class of antennas was developed, known as meander line loaded antennas (MLAs). One such meander line loaded antenna is disclosed in U.S. Pat. No. 5,790,080 for MEANDER LINE LOADED ANTENNA, issued Aug. 4, 1998 to the present inventor, John T. Apostolos, and is hereby incorporated by reference.

An example of a meander line loaded antenna is shown in FIG. 1. The antenna consists of two vertical conductors 102 and a horizontal conductor 104. The vertical and horizontal conductors are separated by gaps 106. Also part of the antenna are meander lines 108, shown in FIG. 2, which inter-connect the vertical and horizontal conductors at the gaps 106. The meander lines 108 are designed to adjust the electrical length of the antenna. In addition, the meander slow wave structure permits switching of lengths of the meander line in or out of the circuit quickly and with negligible loss. This results in selectively changing the effective electrical length of the antenna. Such negligible-loss switching is possible because the meander line 108 includes alternating high and low impedance sections, with active switching devices located in the high impedance sections. This limits the current through the switching devices and results in very low dissipation losses in the switch. Accordingly, high antenna efficiency is maintained.

The meander line loaded antenna, as well as antennas in general, have had certain limitations when used in arrays. Currently, array antennas are very expensive because each antenna receives its own, separate signal. These signals, typically, are generated by using an external corporate feed network. These limitations are further magnified in the case of phased array antennas which achieve directional control by varying the phase of the transmission signal between different array elements, thus requiring phase control for each element. There is a need for an antenna with a fixed or directable pattern that has only a single feed point.

DISCUSSION OF THE RELATED ART

U.S. Pat. No. 5,943,011 entitled ANTENNA ARRAY USING SIMPLIFIED BEAM FORMING NETWORK discloses an example of an antenna array, or multi-element antenna and the feed network used for steering signals transmitted or received through the array. The signals coupled to and from each antenna element 51-58 are adjusted in phase by a network of r.f. hybrid devices 62.

U.S. Pat. No. 5,144,319 entitled PLANAR SUBSTRATE FERRITE/DIODE PHASE SHIFTER FOR PHASED ARRAY APPLICATIONS is an example of a phase shifter which can be used for an individual antenna element within an array. The patent shows the use of this shifter for each antenna element of a phased array.

U.S. Pat. No. 4,010,474 entitled TWO DIMENSIONAL ARRAY ANTENNA discloses a phase control network for the elements of a two dimensional array.

U.S. Pat. No. 5,949,303 entitled MOVABLE DIELECTRIC BODY FOR CONTROLLING PROPAGATION VELOCITY IN A FEED LINE discloses a single phase shifter for use with multiple array elements. As shown in FIG. 1, a feed conductor line 3 includes a source input 6 and multiple antenna element outputs T1–T4. A moveable dielectric material located between the feed line 3, or the carrier plate 5 thereof, and a ground plane 4, controls the propagation velocity of signals coupled through the feed line 3. In this manner a mechanical adjustment is made which determines the phasing of multiple antenna elements.

The prior art very clearly shows the level of complexity that is required for the use of multiple element antenna arrays, both in the need for individual connections as well as the requirements for phase control. They demonstrate the need for simplified coupling and phase control approaches.

It is, therefore, an object of the invention to provide an inexpensive, array antenna having only a single feed point.

It is an additional object of the invention to provide an array antenna having only a single feed point, which includes phase control for individual array elements.

SUMMARY OF THE INVENTION

In accordance with the present invention, there is provided an array antenna capable of use with a single signal feed and including a transmission line oriented substantially parallel to a ground plane, which transmission line has a multiplicity of sequential sections with each sequential section having a different spacing from the ground plane than each of its immediately adjacent sequential sections. Once interconnected, these sequential sections may be referred to as a stepped or varied impedance transmission line in which the sections spaced further from the ground plane become active antenna elements. In one embodiment, an electrical spacing between the transmission line and ground plane affects impedances of the transmission line. Varying this electrical spacing enables relative phase control between the active elements and phased-array directional control of the antenna.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Figure 1:
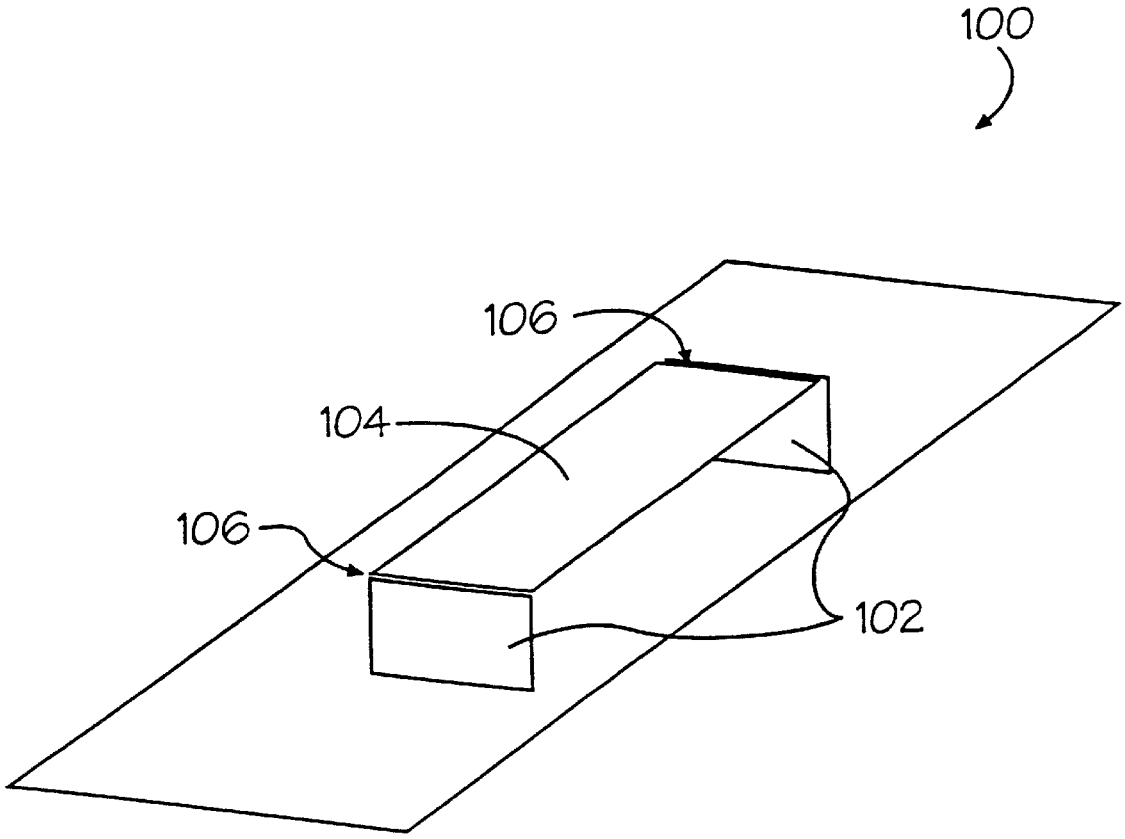
Prior Art Figure 1
FIG. 1 is a perspective view of a meanderline loaded loop antenna of the prior art.
Figure 2:
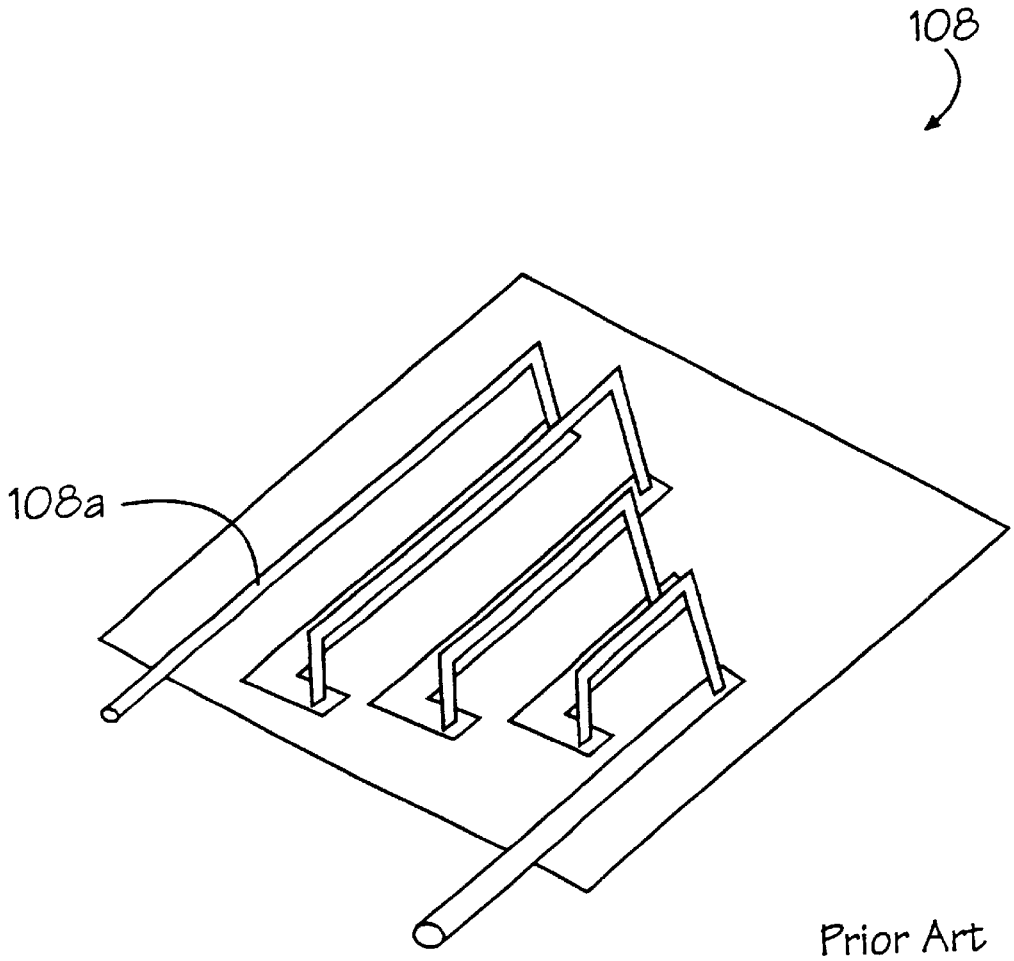
FIG. 2 is a perspective view of a meander line used in conjunction with the prior art antenna of FIG. 1.
Figure 3:
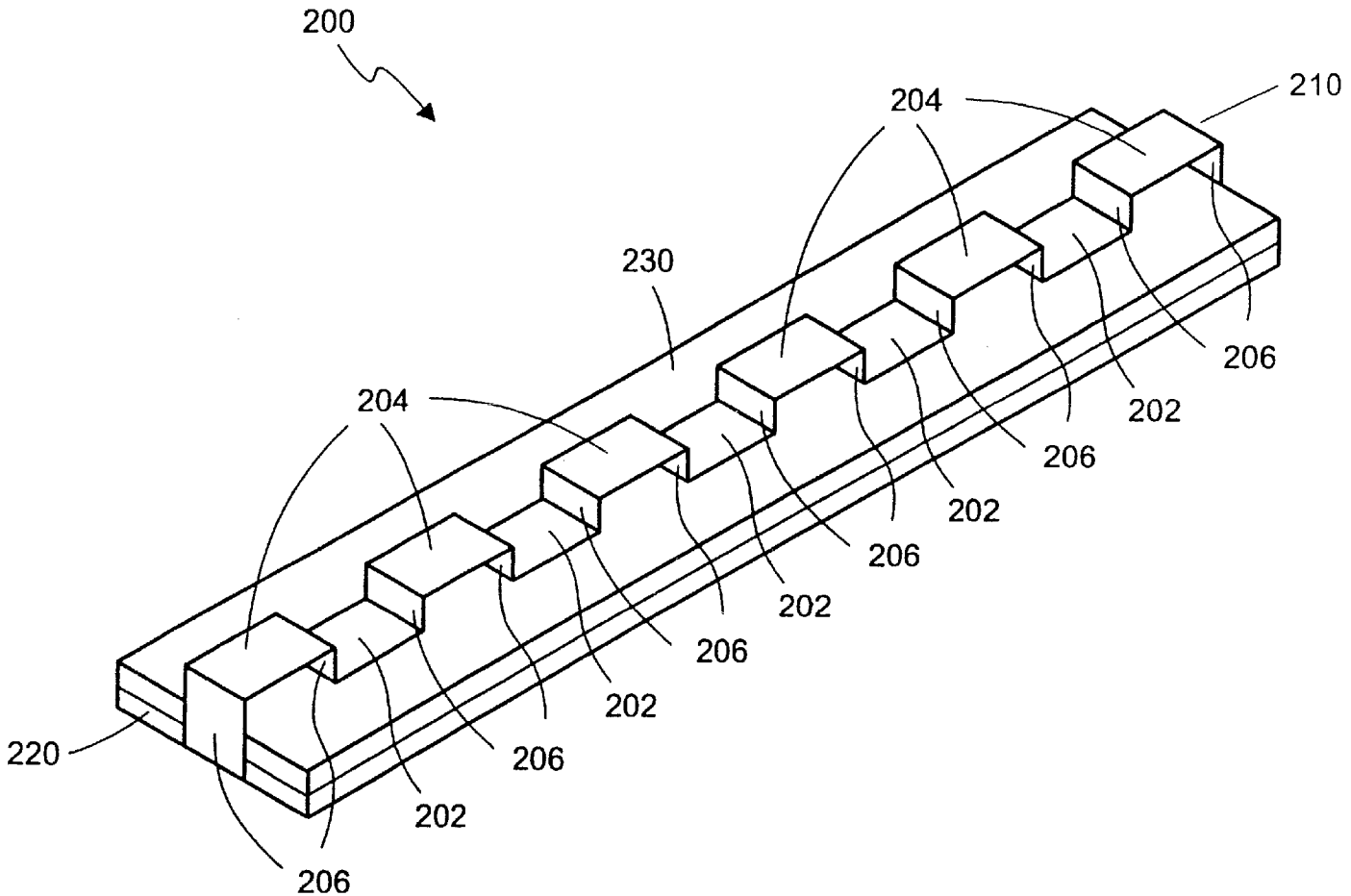
FIG. 3 is a perspective view of an array antenna constructed in accordance with one embodiment of the present invention.

Generally speaking, this invention is related to array antennas. More specifically, there is disclosed an inexpensive, single-feed, array antenna utilizing a stepped impedance transmission line to provide an active antenna array. FIG. 3 shows an example of an array antenna 200 according to one embodiment of the present invention. Antenna 200 generally includes a stepped impedance transmission line 210, a ground plane 220 and a dielectric substrate 230. The unique aspects of the array antenna 200 arise from the stepped impedance nature of transmission line 210 and its proximity to ground plane 220. The greater spacing of every other section 204 from ground plane 220 causes those sections 204 to have a higher relative impedance and to function as individual active array elements. Further, variation of the spacing among active sections 204 enables control of the antenna gain pattern. Still further, the delay line nature of transmission line 210 causes an effect on the phase relationship between the separate active sections 204, which phase relationship can be controlled for directing coherent signal summation for the antenna.

Transmission line 210 includes a multiplicity of sections 202,204 and 206. Planar sections 202 and 204 are oriented substantially parallel to ground plane 220 and are sequentially alternated along transmission line 210. Interconnect sections 206 function to interconnect the sequentially located planar sections 202 and 204, which are nominally oriented in a linear pattern. In one form, transmission line 210 is fabricated from a single metal strip, such as copper, which strip is bent at right degree angles to define the sections 202,204,206.

The planar sections 202 and 204 have different respective spacings or separations from the ground plane 220, which results in different impedance characteristics for those respective sections. A first set of planar sections 202 are located or spaced relatively closer to ground plane 220, which results in a relatively lower impedance, while a second set of planar sections 204 are located or spaced relatively farther away from ground plane 220, resulting in a relatively higher impedance. In the present invention these sections 204, spaced relatively farther from the ground plane, become active elements of the array antenna for both radiating and receiving functions and are alternatively referred to herein as active elements. This impedance variation is referred to as stepped or varied impedance for transmission line 210.

This sequential alternation of sections 202 and 204 may also be described as an inter-digitation of those different sections, so that each sequential section 202, 204 has a different spacing from ground plane 220 than each of its immediately adjacent sequential sections. These different spacings alternate along sequentially connected sections between a relatively larger spacing and a relatively smaller spacing. In other words, planar sections 202 make up a first set of sections, planar sections 204 make up a second set of planar sections, and these first and second sets of planar sections are interdigitated. This is referred to herein as interdigitated, first and second sets of every other sequential section.

Substrate 230 is nominally used to mount the transmission line 210 and ground plane 220 in relation to each other, and substrate 230 may be replaced by any other suitable dielectric medium.

The delay line or slow wave nature of a stepped impedance transmission line is descibed in cited U.S. Pat. No. 5,790,080, which is incorporated herein by reference. The propagation constant, $\beta$, for cases where the ratio of the high impedance to the low impedance ($Z_1/Z_2$) is greater than five and each of the sections is much less than one-quarter wavelength is given by the equation:

$$\beta=\beta_0/2\sqrt{Z_1/Z_2}$$

where: $\beta_0=2\pi/\lambda_0$, and $Z_1$ is the high impedance value and $Z_2$ is the low impedance value.

Thus the propagation velocity through a stepped impedance line is dependent upon the ratio of the alternating impedance values. The factors which are used to control the impedance values and thus the propagation velocity are well known to those skilled in the art and include the size of the transmission line 210, the dielectric constant of the dielectric medium and the spacing between transmission line 210 and ground plane 220. The dielectric medium and the overall spacing between transmission line 210 and ground plane 220 determine an electrical spacing there-between which affects the impedances of the transmission line.

Figure 4:
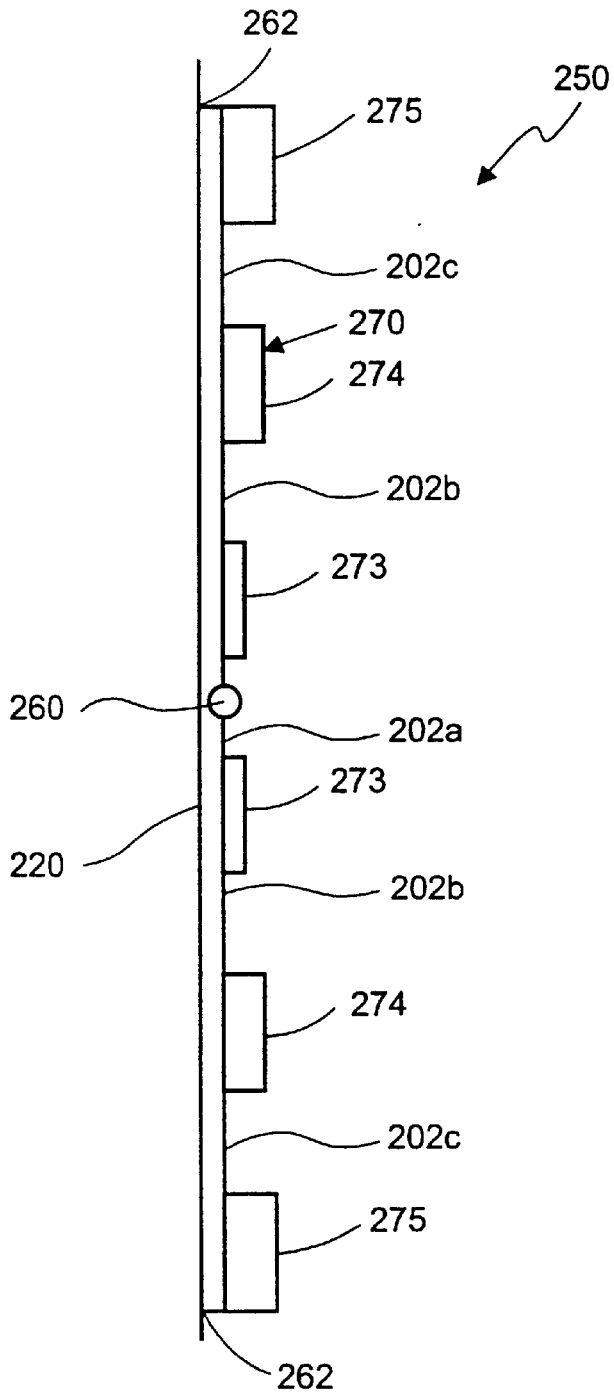
FIG. 4 is a schematic, cross-sectional view of a single feed, center-fed, array antenna as shown in FIG. 1.
Figure 5:
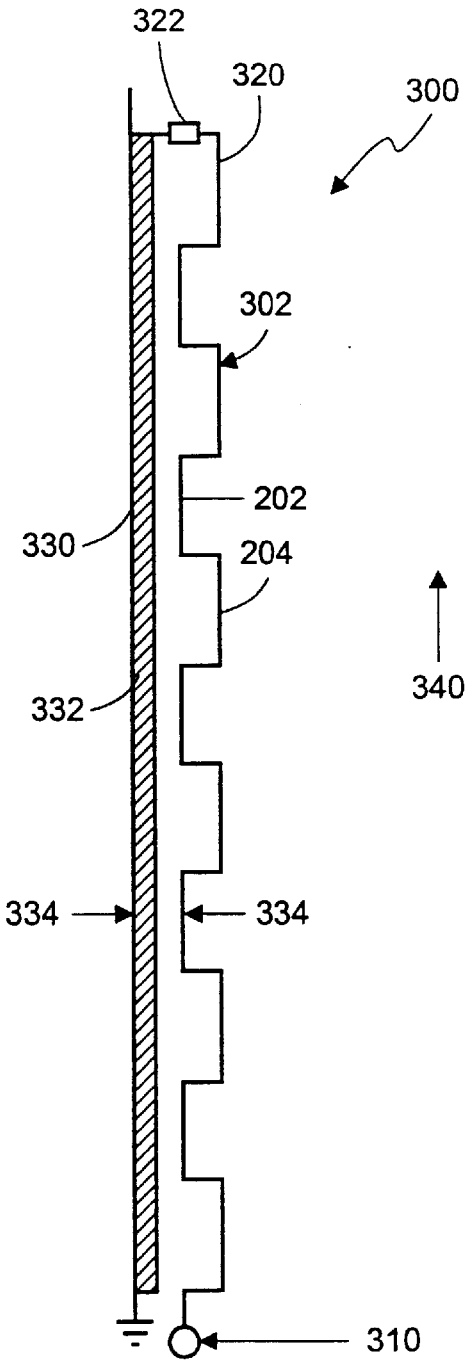
FIG. 5 is a schematic, side view of the array antenna constructed in accordance with another embodiment of the present invention.

The array antenna 200 may be adapted for operation as a single feed array antenna in several variations. Two of these variations are shown in FIGS. 4 and 5, respectively. Antenna 250 of FIG. 4 is shown to have a center feed point 260. The opposite ends of antenna 250 are connected to ground plane 220 from a active element at points 262. This grounding of the antenna ends causes signals coupled though feed point 260 to have a voltage null at each grounded end, which arrangement is known as standing wave excitation. This mode may also be created with a feed point at one end of the transmission line and a ground connection at the other end. Antenna 250 is discussed in greater detail below in reference to FIGS. 6–8.

Another variation of antenna 200 is shown in FIG. 5 as antenna 300, which has a single feed at one end 310 and a termination 322 at the other end 320. This arrangement enables a travelling wave excitation of antenna 300, because a voltage null is not created at any point along the antenna. Antenna 300 may alternately function with a central feed and two terminated ends. Antenna 300 is discussed greater detail below in reference to FIGS. 9 and 10.

The standing wave variation of antenna 250 is now discussed in reference to FIGS. 4, 6, 7, and 8. FIG. 4 shows the antenna 250 having a stepped impedance transmission line 270 similar to that shown in FIG. 3 with some variations. Transmission line 270 is shown to have a similar first set of every other sequential section 202*a*, 202*b*, 202*c* which is located relatively close to ground plane 220. Transmission line 270 differs further in the second set of every other sequential section in that the spacing of the higher impedance sections 273, 274 and 275 is varied over the length of the transmission line 270 to compensate for current characteristics. More specifically, the impedance of the individual sections 273, 274, 275 determines the power which is transmitted by that individual section. This feature enables control of the relative amounts of antenna gain between the individual active elements, thereby providing control of the overall antenna gain pattern. In order to more evenly distribute the gain of antenna 250, the closest sections 273 to the signal feed are given the lowest impedance and the farthest sections from the signal feed are given the highest impedance. Therefore, the spacing from the ground plane of successive active elements may be either progressively larger or smaller. Other variations of these individual spacings may also be used to customize the shape of the resulting gain pattern produced by the array antenna.

As mentioned, the propagation velocity of energy through the transmission line is dependent upon the ratio of the high impedance value of sections 204, 273, 274, 275 to the low impedance value of sections 202*a*, 202*b*, 202*c*. Consistent with varied spacing of the active elements 204, 273, 274, 275 the spacing of low impedance sections 202 may also be selected to maintain or otherwise determine propagation velocity along the transmision line 270.

Further, control of these impedance values can also be used to determine the propagation velocity and thereby, along with the length of the sequential sections, determine the phase relationship of the signals being transmitted by high impedance active sections 204, 273, 274, 275. For this reason, for any given frequency application of the above embodiments, the proper impedance values are predetermined for both the first and second sets of every other planar section in order to design the coherent propagation characteristics of each antenna. The impedence values are determined by known principles taking into account transmission line dimensions, dielectric constant of the dielectric medium, and the spacing of the transmission line from the ground plane. As for the lengths of the sequential sections, in a common embodiment, each of the lengths is substantially equal and is less than one-eighth of the shortest wavelength of operation for the antenna.

It should be noted that both the control of gain distribution and control of relative phase between the active elements are also applicable to the travelling wave embodiment descibed in reference to FIG. 5.

Figure 6:
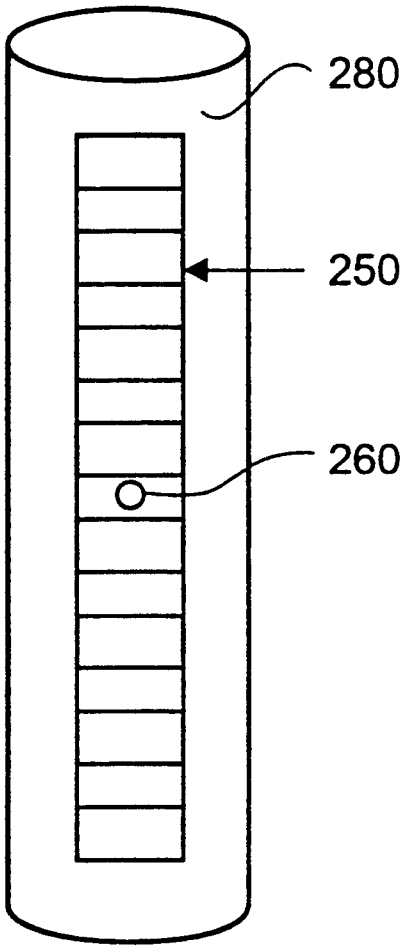
FIG. 6 is a side view of the array antenna of FIG. 4 mounted on a vertical mast.
Figure 7:
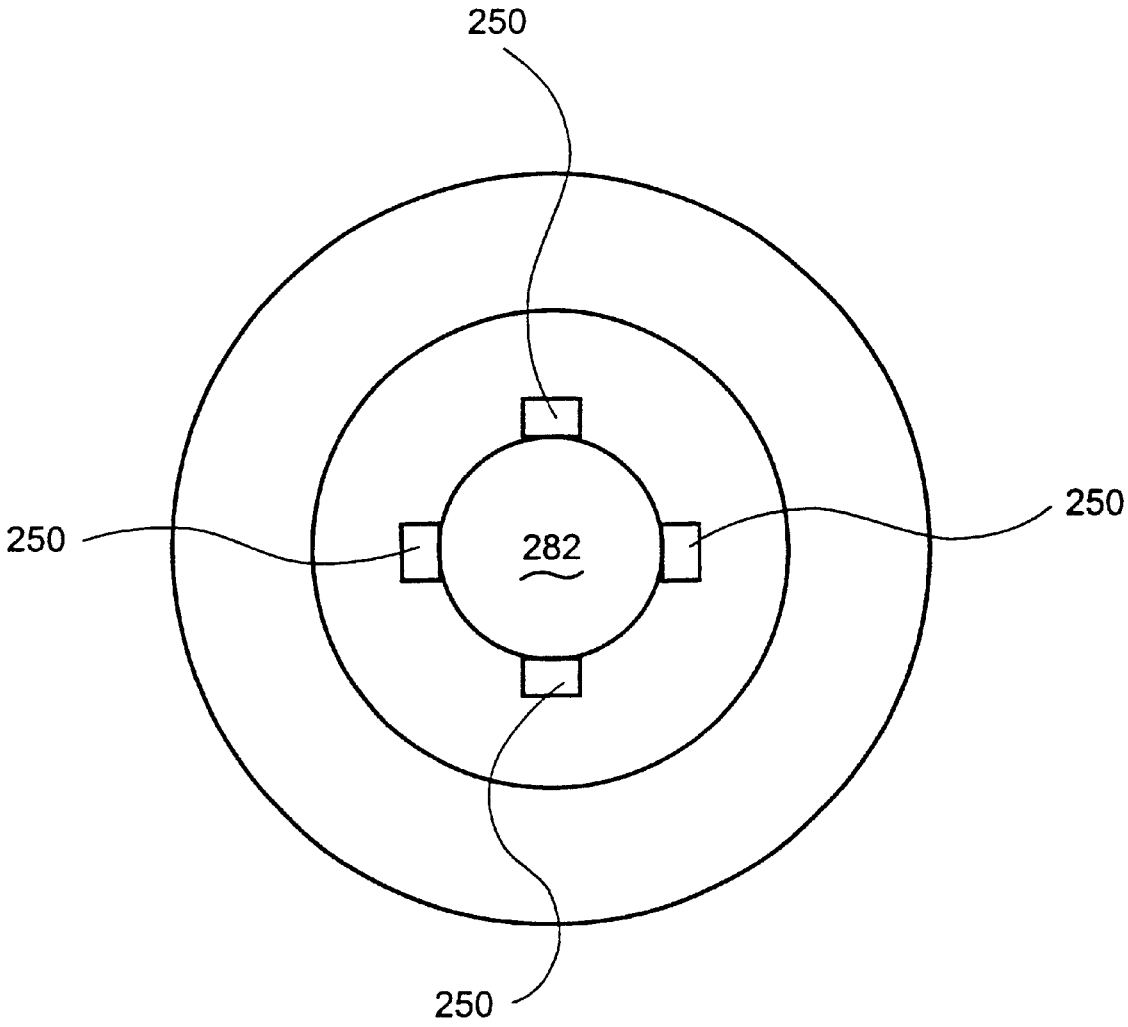
FIG. 7 is a top view of four of the array antennas of FIG. 4 mounted on a mast for omnidirectional operation.
Figure 8:
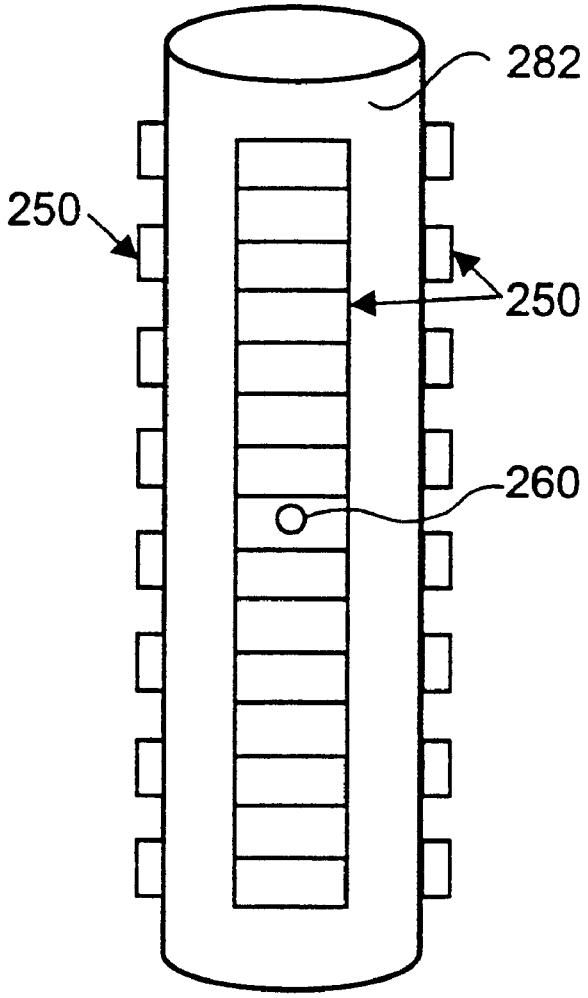
FIG. 8 is a side perspective view of the antenna array of FIG. 7.

Antennas 250, 270 are well suited to mounting on a mast as shown in FIGS. 6, 7 and 8. FIG. 6 shows a single antenna 250 mounted to a mast 280 and having a single center feed 260. An appropriate transmission line, such as a coaxial cable, can be fed through the center of mast 280 to connect to feed 260. FIG. 7 shows a top view of a similar mast 282 having four antennas 250 mounted there-around for omnidirectional coverage. The same signal feed arrangement in the center of mast 282 may be used with a power splitter for dividing, or combining, the signal between separate antennas 250. Although four antennas 250 are shown in FIGS. 7 and 8, greater or fewer numbers may be used depending upon the application.

In reference to FIGS. 5, 9 and 10 a travelling wave embodiment of the present invention will now be described. As noted for FIG. 5, an antenna 300 includes a stepped impedance transmission line 302 having opposed ends at 310 and 320. A single signal feed is coupled to end 310 and the end 320 is terminated with a characteristic impedance 322 (equal to the square root of the product of the high and low impedance values). Transmission line 302 includes interdigitated, lower impedance sections 202 and higher impedance sections 204. These relative impedances are determined in reference to a ground plane 330, which has a dielectric medium 332 mounted thereon. In the present antenna 300, ground plane 330 is moveable in opposing directions 334 with respect to transmission line 302 which allows control of the ratio of impedances between high impedance sections 204 and low impedance sections 202. Movement of ground plane 330 may be accomplished by any suitable means, such as, for example, manipulation with a stepper motor.

It is known that the speed of propagation of signals through this stepped impedance transmission line is inversely proportional to the square root of the ratio of high impedance to low impedance. It is also known that the transmission line and the ground plane have an electrical spacing which affects the impedances of the transmission line. Variation of the electrical spacing between transmission line 302 and ground plane 330 thereby changes both high and low impedances and causes variation of the ratio of those impedances and the speed of propagation through the line 302. This variation of propagation velocity varies the relative wave segments present at each active, high impedance section 204 and thereby varies the direction of coherent wave summation in the direction 340 relative to antenna 300. Variation of the propagation velocity thereby provides phase control to each of the active, high impedance sections 204, all through the single signal feed point 310, and eliminates the need for individual phase control for each of the active elements.

It should be noted that the moveable ground plane 330 is not restricted to use with the travelling wave embodiment of FIG. 5, but may also be used with a standing wave version as described in FIG. 4. In the case of a center fed antenna, such as 250, causing the coherent beams in the two opposite sections to be deflected in the same direction would require separate moveable ground planes for each half, because the opposite current flow in those sections requires opposite relative ground plane movement to produce the same direction of coherent beam deflection.

Figure 9:
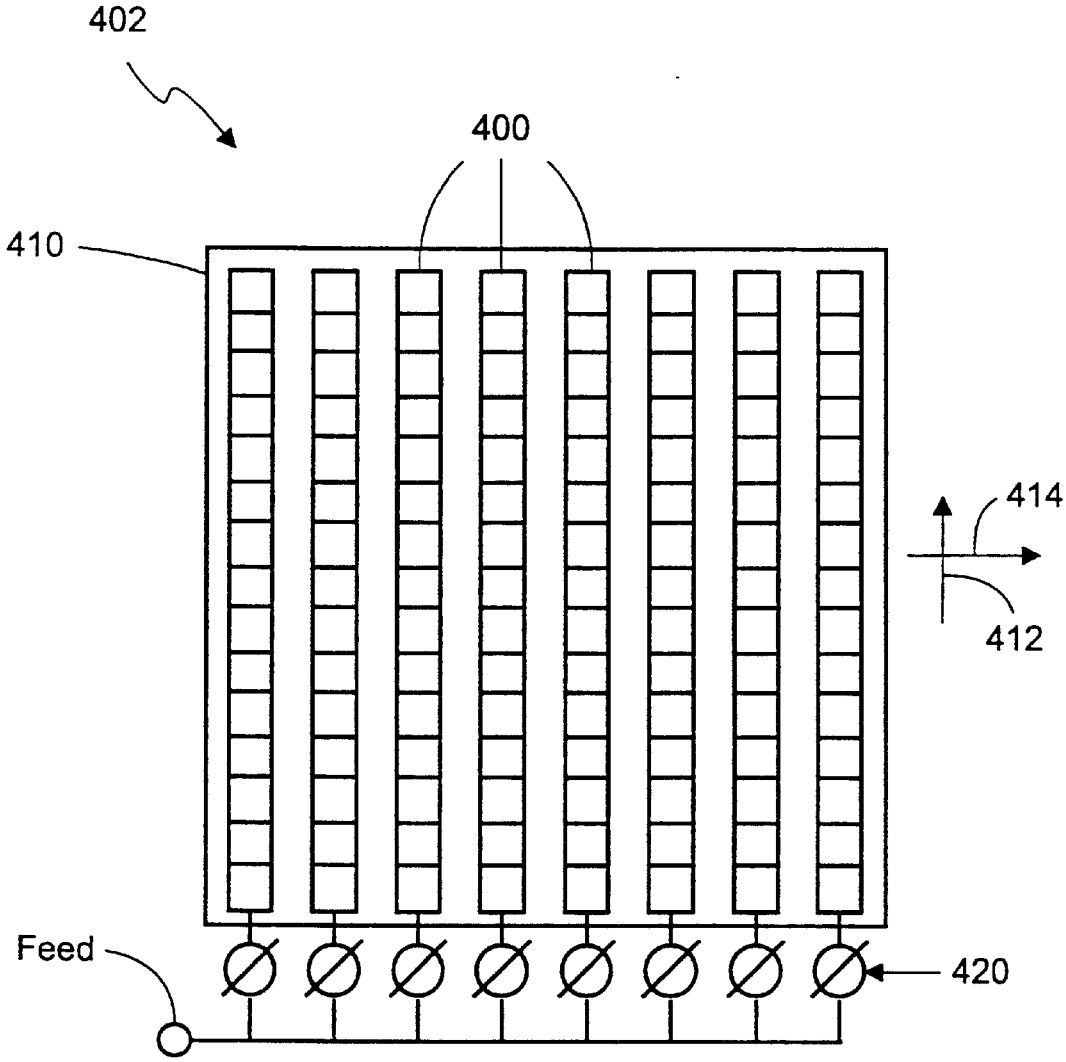
FIG. 9 is a front view of a two-dimensional array of the antenna of FIG. 5.

FIG. 9 shows a multiplicity of array antennas 400 configured to form a two dimensional array 402. Array antennas 400 differ from array antenna 300 only in that all antennas 400 share a common moveable ground plane 410. In this manner, antennas 400 may be coherently directed in the direction 412 by variation of the spacing of this common ground plane 410 from the respective stepped impedance transmission lines of antennas 400. In order to provide further directional control in the orthogonal direction 414, each of the antennas 400 is provided with some form of phase controller 420. Such phase controllers are well known in the art of phased arrays.

Figure 10:
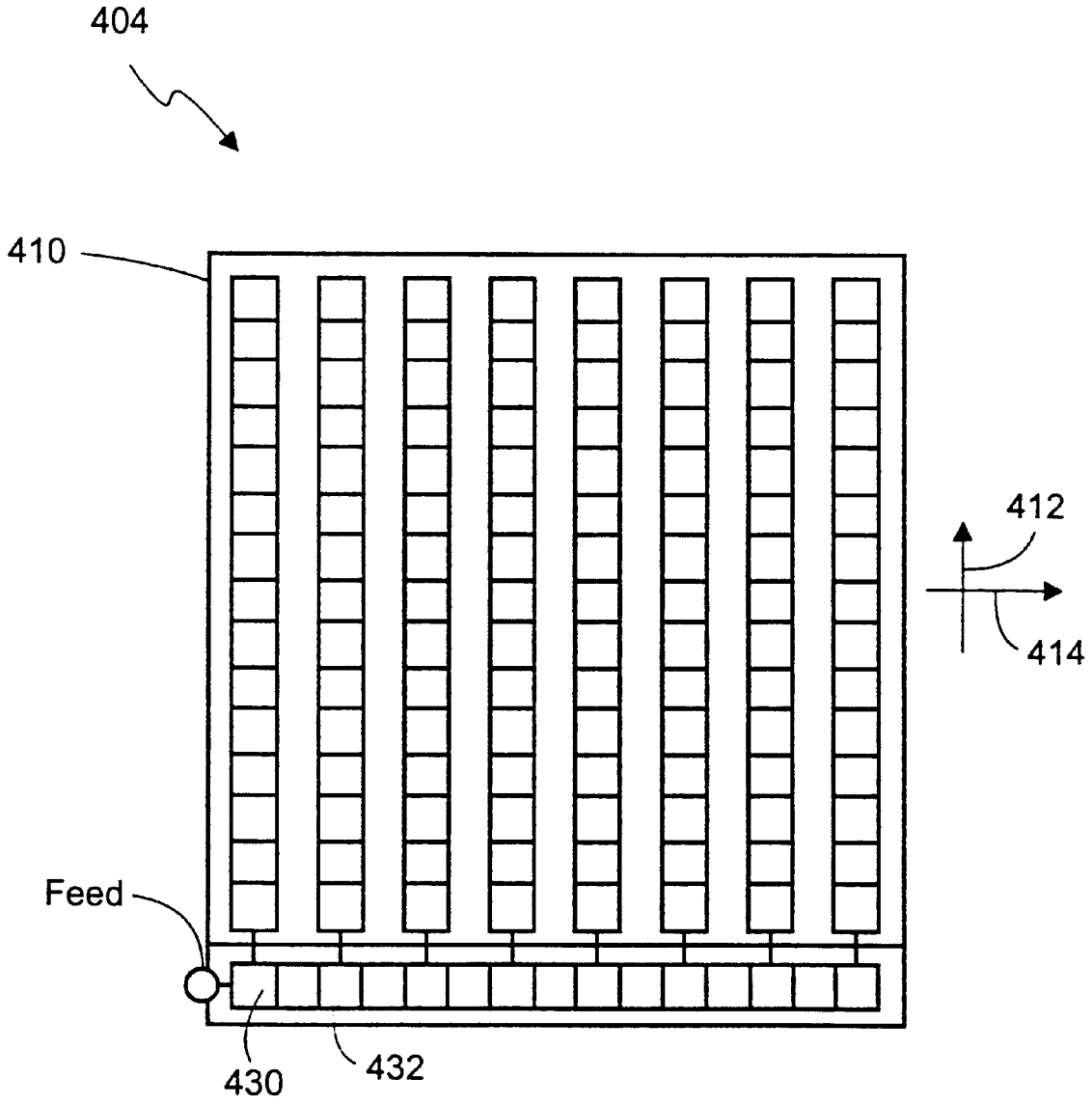
FIG. 10 is a front plane view of a variation of the two-dimensional array of FIG. 9.

FIG. 10 shows further use of the present embodiments as a delay line for full phase control in a two dimensional array 404, which is similar to array 402 of FIG. 9. In FIG. 10, the individual phase controllers 420 of FIG. 9 are replaced by an independently controllable delay line 430 constructed in the identical form as antenna 300. Delay line 430 has the same high and low impedance sections 204, 202 as antenna 300, the propagation speed through which is independently controlled by a separate moveable ground plane 432. In this manner, controllable coherent summation of transmitted and received signals is provided in the orthogonal direction 414, simultaneously with the same control in the original direction 412.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A varied impedance transmission line antenna, comprising:

a ground plane;

a transmission line oriented substantially parallel to said ground plane, said transmission line having a plurality of sequentially stepped sections, wherein said sequentially stepped sections are comprised of alternating high impedance planar sections and low impedance planar sections, said high impedance planar sections at a different spacing from said ground plane than said low impedance planar sections; a plurality of interconnect sections serially interconnecting said high impedance planar sections and said low impedance planar sections; and a means for varying a spacing between said sequentially stepped sections and said ground plane, wherein said means for varying changes a propagation constant ($\beta$) of said transmission line antenna by changing an impedance ratio ($Z_H/Z_L$) of said stepped sections according to ($\beta=\beta_0$ (½) (sqrt($Z_H/Z_L$)), where $Z_H$ is impedance of the high impedance planar sections and $Z_L$ is impedance of the low impedance planar sections, and $\beta_0$ is propagation constant for a similar transmission line of constant impedance.

2. The varied impedance transmission line antenna according to claim 1, wherein said means for varying is a mechanically moveable ground plane.

3. The varied impedance transmission line antenna according to claim 1, wherein said high impedance planar sections are separated from said ground plane by a high impedance spacing, wherein said high impedance spacing is approximately similar for each of said high impedance planar sections.

4. The varied impedance transmission line antenna according to claim 1, wherein said low impedance planar sections are separated from said ground plane by a low impedance spacing, wherein said low impedance spacing is approximately similar for each of said low impedance planar sections.

5. The varied impedance transmission line antenna according to claim 1, wherein said high impedance planar sections are separated from said ground plane by a high impedance spacing, wherein said high impedance spacing differs between adjacent said high impedance planar sections.

6. The varied impedance transmission line antenna according to claim 1, wherein said low impedance planar sections are separated from said ground plane by a low impedance spacing, wherein said low impedance spacing differs between adjacent said low impedance planar sections.

7. The varied impedance transmission line antenna according to claim 1, further comprising a single central feed in said transmission line, wherein said transmission line is grounded at each respective end, resulting in a standing wave excitation.

8. The varied impedance transmission line antenna according to claim 1, further comprising a single central feed in said transmission line, wherein said transmission line is terminated at each respective end, resulting in a traveling wave excitation.

9. The varied impedance transmission line antenna according to claim 1, further comprising a single end feed on said transmission line, wherein an opposing end of said transmission line is grounded, resulting in a standing wave excitation.

10. The varied impedance transmission line antenna according to claim 1, further comprising a single end feed on said transmission line, wherein an opposing end of said transmission line is terminated, resulting in a traveling wave excitation.

11. The varied impedance transmission line antenna according to claim 1, wherein said high impedance planar sections are separated from said ground plane by a high impedance spacing, wherein said high impedance spacing is approximately similar for each of said high impedance planar sections.

12. The varied impedance transmission line antenna according to claim 1, wherein said low impedance planar sections are separated from said ground plane by a low impedance spacing, wherein said low impedance spacing is approximately similar for each of said low impedance planar sections.

13. The varied impedance transmission line antenna according to claim 1, wherein said high impedance planar sections are separated from said ground plane by a high impedance spacing, wherein said high impedance spacing differs between adjacent said high impedance planar sections.

14. The varied impedance transmission line antenna according to claim 1, wherein said low impedance planar sections are separated from said ground plane by a low impedance spacing, wherein said low impedance spacing differs between adjacent said low impedance planar sections.

15. The varied impedance transmission line antenna according to claim 1, further comprising a single central feed in said transmission line, wherein said transmission line is grounded at each respective end, resulting in a standing wave excitation.

16. The varied impedance transmission line antenna according to claim 1, further comprising a single central feed in said transmission line, wherein said transmission line is terminated at each respective end, resulting in a traveling wave excitation.

17. The varied impedance transmission line antenna according to claim 1, further comprising a single end feed on said transmission line, wherein an opposing end of said transmission line is grounded, resulting in a standing wave excitation.

18. The varied impedance transmission line antenna according to claim 1, further comprising a single end feed on said transmission line, wherein an opposing end of said transmission line is terminated, resulting in a traveling wave excitation.

19. A varied impedance transmission line antenna, comprising:

a ground plane;

a transmission line oriented substantially parallel to said ground plane, said transmission line having a plurality of sequentially stepped sections, wherein said sequentially stepped sections are comprised of alternating high impedance planar sections and low impedance planar sections, said high impedance planar sections at a different spacing from said ground plane than said low impedance planar sections;

a plurality of interconnect sections serially interconnecting said high impedance planar sections and said low impedance planar sections; and a dielectric medium disposed between said ground plane and said transmission line; and a ground plane, wherein said ground plane is moveable and varies a spacing between said transmission line and said ground plane, wherein varying said spacing changes a propagation constant ($\beta$) of said transmission line antenna by changing an impedance ratio ($Z_H/Z_L$) of said stepped sections according to ($\beta=\beta_0$ (½)(sqrt($Z_H/Z_L$)), where $Z_H$ is impedance of the high impedance planar sections and $Z_L$ is impedance of the low impedance planar sections, and $\beta_0$ is propagation constant for a similar transmission line of constant impedance.

* * * * *